US009547249B2

(12) United States Patent
Kochi

(10) Patent No.: US 9,547,249 B2
(45) Date of Patent: Jan. 17, 2017

(54) IMAGE FORMING APPARATUS

(71) Applicant: Naoto Kochi, Kanagawa (JP)

(72) Inventor: Naoto Kochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/822,180

(22) Filed: Aug. 10, 2015

(65) Prior Publication Data

US 2016/0091816 A1 Mar. 31, 2016

(30) Foreign Application Priority Data

Sep. 26, 2014 (JP) ..... 2014-196619
Nov. 17, 2014 (JP) ..... 2014-232607

(51) Int. Cl.
*G03G 15/16* (2006.01)
*G03G 15/01* (2006.01)
*G03G 15/00* (2006.01)

(52) U.S. Cl.
CPC ..... *G03G 15/0131* (2013.01); *G03G 15/0189* (2013.01); *G03G 15/1605* (2013.01); *G03G 15/6591* (2013.01); *G03G 15/1615* (2013.01); *G03G 15/1675* (2013.01); *G03G 2215/0119* (2013.01); *G03G 2215/0177* (2013.01)

(58) Field of Classification Search
CPC ..... G03G 15/16
USPC ..... 399/66
See application file for complete search history.

(56) References Cited

U.S. PATENT DOCUMENTS 5,510,886 A 4/1996 Sugimoto et al.
2010/0080589 A1* 4/2010 Yoshioka ..... G03G 15/1605 399/45
2012/0008991 A1* 1/2012 Shimizu ..... G03G 15/1675 399/297
2012/0045237 A1* 2/2012 Aoki ..... G03G 15/1675 399/66

(Continued)

FOREIGN PATENT DOCUMENTS

JP 6-332324 12/1994
JP 2000-162899 6/2000
JP 2013-125053 6/2013

OTHER PUBLICATIONS

U.S. Appl. No. 14/712,307, filed May 14, 2015.

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

An image forming apparatus includes an image forming station, an intermediate transfer body, a transfer device, a transfer pressure applicator, and a controller. The image forming station forms a toner image. The toner image formed by the image forming station is transferred onto the intermediate transfer body. The transfer device transfers the toner image from the intermediate transfer body onto a recording medium. The transfer pressure applicator applies a secondary transfer pressure to the recording medium upon transfer of the toner image and to apply a lower secondary transfer pressure upon transfer of a toner image including a special color toner than that upon transfer of a toner image without the special color toner. The controller is operatively connected to the transfer pressure applicator to control the transfer pressure applicator.

20 Claims, 8 Drawing Sheets

(56) References Cited

U.S. PATENT DOCUMENTS

| | | | | |
|---|---|---|---|---|
| 2012/0224873 | A1* | 9/2012 | Aoki | G03G 15/161 399/66 |
| 2013/0148993 | A1* | 6/2013 | Aoki | G03G 15/0131 399/66 |
| 2013/0164011 | A1* | 6/2013 | Nakamura | G03G 15/1675 399/66 |
| 2013/0308968 | A1* | 11/2013 | Tanaka | G03G 15/1675 399/44 |
| 2014/0079418 | A1* | 3/2014 | Tanaka | G03G 15/1605 399/44 |
| 2014/0270875 | A1* | 9/2014 | Mimbu | B66F 19/00 399/329 |
| 2014/0328604 | A1* | 11/2014 | Tanaka | G03G 15/1605 399/66 |
| 2015/0346651 | A1* | 12/2015 | Nagata | G03G 15/1605 399/45 |
| 2016/0091816 | A1* | 3/2016 | Kochi | G03G 15/0131 399/66 |

* cited by examiner

IMAGE FORMING APPARATUS

CROSS-REFERENCE TO RELATED APPLICATIONS

This patent application is based on and claims priority pursuant to 35 U.S.C.§119 from Japanese Patent Application Nos. 2014-232607, filed on Nov. 17, 2014, and 2014-196619, filed on Sep. 26, 2014, both in the Japan Patent Office, which are hereby incorporated herein by reference in their entirety.

BACKGROUND

Technical Field

Exemplary aspects of the present disclosure generally relate to an image forming apparatus, and more particularly to an image forming apparatus such as a copier, a facsimile machine, a printer, a plotter or a multi-functional system including a combination thereof, and more particularly to an image forming apparatus using a toner other than process colors such as yellow, magenta, cyan, and black.

Description of the Related Art

Market demand has grown for an ability to add extra values to output images in on-demand printing. In order to satisfy such market demand, there have known color image forming apparatuses capable of producing images using a special color toner. The image forming apparatuses of this type are normally equipped with at least one image forming unit for the special color toner in addition to image forming units for the process colors.

There are various kinds of special color toners: a colorless, transparent toner also known as a clear toner, a white toner, an auxiliary color toner to support a color that is difficult to reproduce with process colors. For example, in order to enhance color development of a color image, a solid white image is formed on an entire surface of colored paper as a base with a white toner, or an uppermost layer of an image surface is formed with the white toner when forming an image on a transparent film based on an assumption that the transparent film is viewed from the back. The use of the special color toner is different from the conventional use of color toners.

In the image forming apparatuses equipped with the special color toner, upon printing an image with the superimposed special color toner, depending on the type of recording media, a toner image is not transferred properly at a secondary transfer portion, resulting in a transfer failure such as a partial toner transfer failure known as toner dropouts (blank spots).

It is known that in general, a highly pressurized toner upon transfer process causes toner dropouts. Prior to the transfer process, the toner layer is formed in a state in which there is a space between toner particles. Upon transfer, pressure is applied to the toner particles, thereby packing the toner particles together and increasing adhesion between the packed toner and a photoconductor (in secondary transfer process, adhesion between the toner and an intermediate transfer belt). As a result, the toner cannot be transferred to the intermediate transfer belt (in the secondary transfer process, to a recording medium), which results in toner dropouts even when a transfer electric field is applied.

Toner dropouts tend to occur easily with a large amount of toner (hereinafter referred to as a toner adhesion amount). Furthermore, toner dropouts occur more easily at a periphery portion of a fine line image and a solid image, the toner adhesion amount of which tends to be excessive due to a so-called edge effect in development. Furthermore, in addition to color toners in yellow, magenta, cyan, and black, when printing with the special color toner, the toner adhesion amount of a toner image formed on the intermediate transfer belt tends to be greater than when printing a normal color image. As a result, toner dropouts occur easily during secondary transfer process.

It is known that when the relation of friction coefficients μ of a photoconductor (Pμ), an intermediate transfer belt (Iμ), and a recording medium (Rμ) satisfies Pμ<Iμ<Rμ, suppression of toner dropouts tends to be more significant than that using paper having a high smoothness and a low friction coefficient μ such as gloss coated paper. The relation of friction coefficients of the gloss coated paper is degraded, and hence the toner image is not transferred properly, resulting in toner dropouts.

SUMMARY

In view of the foregoing, in an aspect of this disclosure, there is provided an improved (or novel) image forming apparatus including an image forming station, an intermediate transfer body, a transfer device, a transfer pressure applicator, and a controller. The image forming station forms a toner image. The toner image formed by the image forming station is transferred onto the intermediate transfer body. The transfer device transfers the toner image from the intermediate transfer body onto a recording medium. The transfer pressure applicator applies a secondary transfer pressure to the recording medium upon transfer of the toner image and to apply a lower secondary transfer pressure upon transfer of a toner image including a special color toner than that upon transfer of a toner image without the special color toner. The controller is operatively connected to the transfer pressure applicator to control the transfer pressure applicator.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
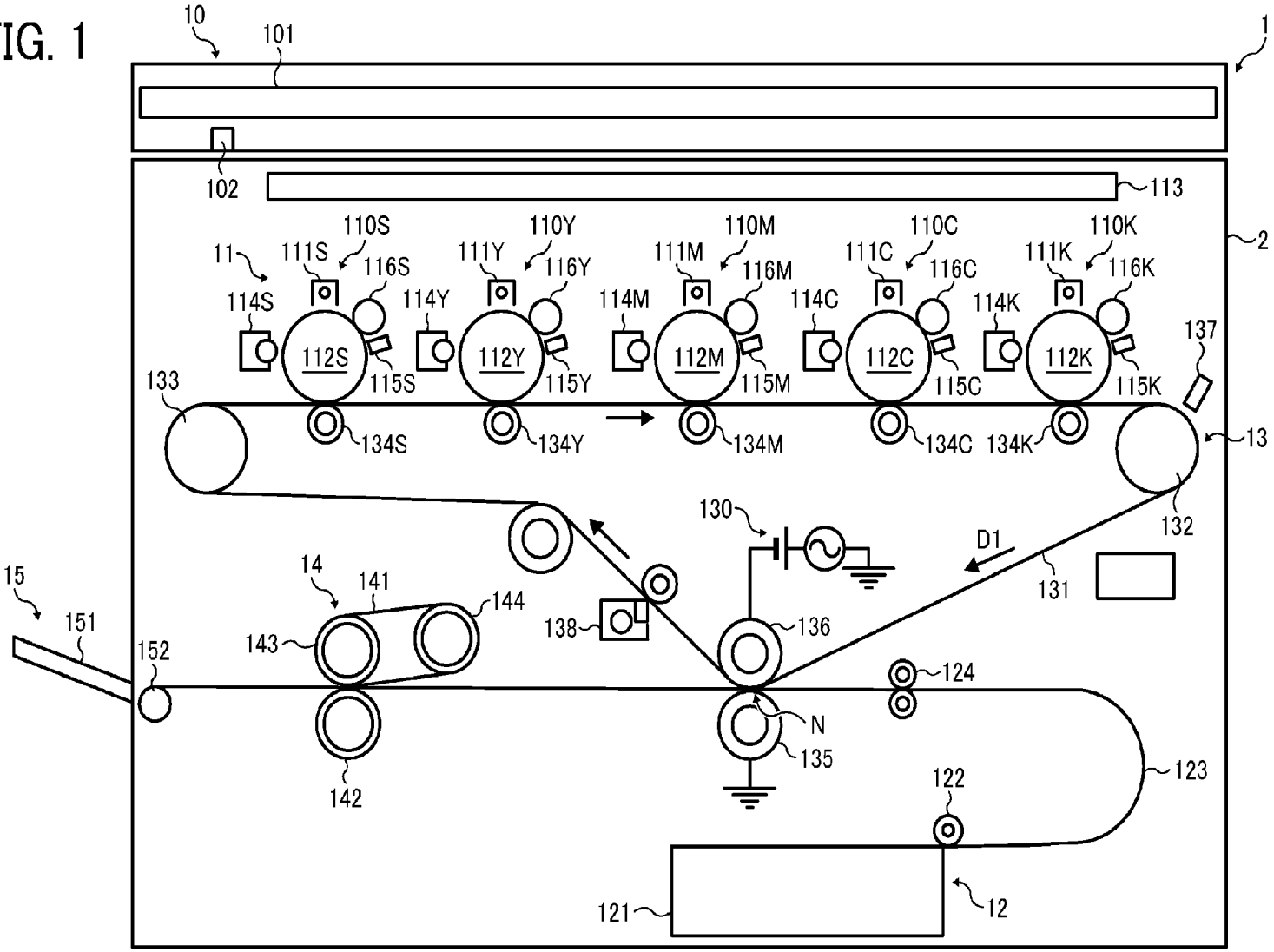
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an example of an image forming apparatus according to an illustrative embodiment of the present disclosure.

An image forming apparatus 1 illustrated in FIG. 1 is a tandem-type color image forming apparatus in which multiple image forming stations are arranged in tandem. The image forming apparatus 1 includes an image reader 10, an image forming unit 11, a paper feed unit 12, a transfer unit 13, a fixing unit 14, and a paper output unit 15.

The image reader 10 reads a document image and generates image information. The image reader 10 includes an exposure glass 101 and a reading device 102 such as a Charge Coupled Device (CCD) and a Contact Image Sensor (CIS) The image reader 10 irradiates light against the document. The reading device 102 receives light reflected upon the document, and reads electrical color-separation signals for each of three primary colors of light, i.e., red, green, and blue.

The image forming unit 11 includes image forming stations 110S, 110Y, 110M, 110C, and 110K, one for each of colors, special color, yellow, magenta, cyan, and black, respectively. It is to be noted that the suffixes S, Y, C, M, and K denote the colors, special color, yellow, cyan, magenta, and black, respectively. Special color herein refers to a color that cannot be produced with the toners of yellow, cyan, magenta, and black, for example, a clear toner, metallic, white, and so forth. To simplify the description, the suffixes S, Y, M, C, and K indicating colors are omitted herein unless otherwise specified.

The image forming stations 110S, 110Y, 110M, 110C, and 110K all have the same configuration, differing only in the color of toner employed. The image forming stations 110S, 110Y, 110M, 110C, and 110K employ toners of different colors, that is, special color, yellow, magenta, cyan, and black, respectively. The image forming stations 1005, 100Y, 100M, 100C, and 100K are replaced upon reaching their product life cycles. Each of image forming stations 110S, 110Y, 110M, 110C, and 110K is detachably mountable as a process cartridge relative to a main body 2 of the image forming apparatus 1.

The image forming stations 110S, 110Y, 110M, 110C, and 110K all have the same configuration, differing only in the color of toner employed. Thus, a description is provided of the image forming station 110K as a representative example of the image forming stations.

The image forming station 110K includes a charging device 111K, a photoconductor 112K serving as an image bearer or a latent image bearer, a developing device 114K, a static eliminator 115K, a photoconductor cleaner 116K, and so forth. These devices are held in a common holder so that they are detachably attachable together and replaceable at the same time.

The photoconductor 112K includes a drum-shaped base on which an organic photosensitive layer is disposed, with the external diameter of approximately 60 mm. The photoconductor 112K is rotated in a counterclockwise direction by a driving device. The charging device 111K includes a charging wire serving as a charge electrode of a charger. A charging bias is applied to the charging wire to generate electrical discharge between the charging wire and the outer peripheral surface of the photoconductor 112K. Accordingly, the surface of the photoconductor 112K is uniformly charged. According to the present illustrative embodiment, the photoconductor 112K is uniformly charged with a negative polarity which is the same polarity as the polarity of normally-charged toner. As a charging bias, an alternating current (AC) voltage superimposed on a direct current (DC) voltage is employed. Alternatively, instead of using the charger, in some embodiments, a charging roller that contacts the photoconductor 112K or is disposed near the photoconductor 112K is employed.

The uniformly charged surface of the photoconductor 112K is scanned by laser light emitted from an exposure device 113, thereby forming an electrostatic latent image for black on the surface of the photoconductor 112K. The potential of the irradiated portion of the photoconductor 112K attenuates and becomes less than the potential of other areas, that is, a background portion (non-image portion), thereby forming the electrostatic latent image on the photoconductor 112K.

The developing device 114K includes a container that stores a two-component developing agent including black toner and carrier particles. A developing sleeve disposed inside the container includes a magnetic roller inside the developing sleeve. The magnetic force of the magnetic roller attracts the developing agent onto the surface of the developing sleeve. A developing bias having the same polarity as that of the toner is applied to the developing sleeve. The developing bias has a potential greater than that of the electrostatic latent image on the photoconductor 112K, but less than the charging potential of the photoconductor 112K. With this configuration, a developing potential that causes the toner on the developing sleeve to move electrostatically to the electrostatic latent image on the photoconductor 112K acts between the developing sleeve and the electrostatic latent image on the photoconductor 112K.

A non-developing potential acts between the developing sleeve and the background portion or the non-image formation area of the photoconductor 112, causing the toner on the developing sleeve to move to the sleeve surface. Due to the developing potential and the non-developing potential, the toner on the developing sleeve adheres selectively to the electrostatic latent image formed on the photoconductor 112K, thereby forming a visible image, known as a toner image.

The static eliminator 115K removes residual charges remaining on the surface of the photoconductor 112K after the toner image is transferred primarily onto an intermediate transfer belt 131 in a primary transfer process. The photoconductor cleaner 116K includes a cleaning blade and a cleaning brush to remove residual toner remaining on the surface of the photoconductor 112K after the static eliminator 115K removes charges from the surface of the photoconductor 112K.

The exposure device 113 serving as a latent image writer or an exposure mechanism is disposed above the image forming stations 110S, 110Y, 110M, 110C, and 110K. Based on image information provided by external devices such as a personal computer (PC), the exposure device 113 illuminates the photoconductors 112S, 112Y, 112M, 112C, and 112K with laser light projected from a light source such as a laser diode of the exposure device 113.

The exposure device 113 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby irradiating the photoconductors 112S, 112Y, 112M, and 112C. Instead of using laser light, alternatively, the exposure device 113 may employ a plurality of light emitting diodes (LED) to optically write with LED light.

The paper feed unit 12 supplies recording media P to the transfer unit 13. The paper feed unit 12 includes a paper bank 121, a pickup roller 122, a conveyor belt 123, and a pair of registration rollers 124. The pickup roller 122 rotates to pick up a recording medium P loaded in the paper bank 121 and feed it to the conveyor belt 123. The pickup roller 122 picks up a top sheet of recording media P loaded in the paper bank 121 one by one, and feeds it to the conveyor belt 123. The conveyor belt 123 transports the recording medium P picked up by the pickup roller 122 to the transfer unit 13. The pair of registration rollers 124 feeds the recording medium P to a secondary transfer nip N at which the intermediate transfer belt 131 meets a secondary transfer roller 135, in appropriate timing such that the recording medium P is aligned with a toner image formed on the intermediate transfer belt 131.

The transfer unit 13 is disposed substantially below the image forming stations 110S, 110Y, 110M, 110C, and 110K. The transfer unit 13 includes a driving roller 132, a driven roller 133, the intermediate transfer belt 131, primary transfer rollers 134S, 134Y, 134M, 134C, and 134K, the secondary transfer roller 135, a secondary-transfer opposed roller 136, a toner detector 137, a belt cleaning device 138, and so forth.

The intermediate transfer belt 131 is looped around and stretched taut by the driving roller 132, the driven roller 133, the secondary-transfer opposed roller 136, the primary transfer rollers 134S, 134Y, 134M, 134C, and 134K, and so forth, which are all disposed inside the loop formed by the intermediate transfer belt 131. The intermediate transfer belt 131 serves as an endless intermediate transfer body. The driving roller 132 is driven to rotate clockwise in FIG. 1 by a drive motor, and the rotation of the driving roller 132 enables the intermediate transfer belt 131 to endlessly move clockwise indicated by arrow D1 in FIG. 1 while contacting the photoconductors 112S, 112Y, 112M, 112C, and 112K.

The intermediate transfer belt 131 has a thickness in a range from 20 μm to 200 μm, preferably, approximately 60 μm. The volume resistivity thereof is in a range from $1\times10^{6}$ Ωcm to $1.0\times10^{12}$ Ωcm, preferably, approximately $1\times10^{9}$ Ωcm. The volume resistivity is measured with an applied voltage of 100V by a high resistivity meter, Hiresta UPM-CPHT 45 manufactured by Mitsubishi Chemical Corporation. Preferably, material of the intermediate transfer belt 131 includes, but is not limited to polyimide resin in which carbon is dispersed.

According to the illustrative embodiment shown in FIG. 1, the toner detector 137 is disposed above and in proximity to the intermediate transfer belt 131 looped around the driving roller 132 with a certain space therebetween. The toner detector 137 detects an amount of toner in a toner image transferred onto the intermediate transfer belt 131. The toner detector 137 includes a reflective-type photosensor. The toner detector 137 measures the toner adhesion amount in such a manner that the intensity of light reflected from a toner image (including a special color toner) adhered to or formed on the intermediate transfer belt 131. According to the present illustrative embodiment, the special color toner includes, but is not limited to, toners in special colors other than yellow, cyan, magenta, and black. For example, the special color toner includes, but is not limited to, a white toner, a metal color toner, a transparent toner, a fluorescent toner, a foam toner, and a spot color toner.

A generally-used known toner density detector that detects and measures the toner density may serve as the toner detector 137. In this case, an additional toner detector is not required, thereby reducing the number of constituent parts and hence reducing the cost. In some embodiments, the toner detector 137 is disposed at a position at which the toner detector 137 detects the toner image on the photoconductor 112.

The primary transfer rollers 134S, 134Y, 134M, 134C, and 134K are disposed opposite the respective photoconductors 112S, 112Y, 112M, 112C, and 112K via the intermediate transfer belt 131, and are rotated to move the intermediate transfer belt 131 in the direction of arrow D1. Accordingly, primary transfer nips, at which the outer peripheral surface or the image bearing surface of the intermediate transfer belt 131 and the photoconductors 112S, 112Y, 112M, 112C, and 112K contact, are formed. A primary transfer bias under constant current control is applied to the primary transfer rollers 134S, 134Y, 134M, 134C, and 134K. Accordingly, a transfer electric field is formed between the primary transfer rollers 134S, 134Y, 134M, 134C, and 134K, and the toner images of special color, yellow, magenta, cyan, and black formed on the photoconductors 112S, 112Y, 112M, 112C, and 112K, respectively.

Each of the primary transfer rollers 134S, 134Y, 134M, 134C, and 134K is constituted of an elastic roller including a metal cored bar on which a conductive sponge layer is fixated. A resistance R of the sponge layer is approximately $3\times10^{7}\Omega$. According to the present illustrative embodiment, a roller-type primary transfer device is used as the primary transfer rollers 134S, 134Y, 134M, 134C, and 134K. Alternatively, a transfer charger and a brush-type transfer device may be employed as the primary transfer device.

The intermediate transfer belt 131 and a recording medium P are interposed between the secondary transfer roller 135 and the secondary-transfer opposed roller 136, and the secondary transfer roller 135 rotates. Accordingly, the peripheral surface or the image bearing surface of the intermediate transfer belt 131 contacts the secondary transfer roller 135, thereby forming a place of contact, a so-called a secondary transfer nip N. The secondary transfer roller 135 serves as a nip forming member and as a transfer device. The secondary-transfer opposed roller 136 serves as a nip forming member and as an opposed roller.

According to the present illustrative embodiment, the secondary transfer roller 135 is grounded, and a secondary transfer bias is applied to the secondary-transfer opposed roller 136 by a secondary transfer bias power source 130. The secondary transfer bias power source 130 includes a direct current (DC) power source and an alternating current (AC) power source, and an alternating current (AC) voltage superimposed on a direct current (DC) voltage is output as the secondary transfer bias. An output terminal of the secondary transfer bias power source 130 is connected to the metal cored bar of the secondary-transfer opposed roller 136. The potential of the metal cored bar of the secondary-transfer opposed roller 136 has a similar or the same value as the output voltage output from the secondary transfer bias power source 130.

By applying the secondary transfer bias to the secondary-transfer opposed roller 136, a secondary transfer electric field is formed between the secondary-transfer opposed roller 136 and the secondary transfer roller 135 so that the toner having a negative polarity is transferred electrostatically from the secondary-transfer opposed roller side to the secondary transfer roller side. With this configuration, the toner having the negative polarity on the intermediate transfer belt 131 is moved from the secondary-transfer opposed roller side to the secondary transfer roller side.

The secondary transfer bias power source 130 employs a direct current (DC) component having the same negative polarity as that of the toner, and the time-averaged potential of the superimposed bias has the same negative polarity as that of the toner. According to the present illustrative embodiment, the metal cored bar of the secondary transfer roller 135 is grounded while the superimposed bias is applied to the metal cored bar of the secondary-transfer opposed roller 136. Alternatively, in some embodiments, the metal cored bar of the secondary-transfer opposed roller 136 is grounded while the superimposed bias is applied to the secondary transfer roller 135. In this case, the polarity of the DC voltage and DC component is changed.

When using a recording medium P having a coarse surface such as an embossed sheet having a relatively high degree of surface roughness, it is known that application of the superimposed bias can move the toner from the intermediate transfer belt side to the recording medium side while moving the toner back and forth, thereby transferring relatively the toner onto the recording medium P. With this configuration, the transferability of the toner relative to the recessed portions on the recording medium P is enhanced, thus preventing image defects such as toner dropouts and blank spots. When using a regular sheet of paper or the like, such as the one having a relatively low degree of surface roughness, a pattern of dark and light according to the surface conditions of the recording medium P is less likely to appear on the surface thereof. In this case, application of the secondary transfer bias including only the DC component can achieve desired transferability.

The secondary-transfer opposed roller 136 is constituted of a metal cored bar made of, for example, stainless steel and aluminum, and a resistance layer is laminated on the cored bar. The outer diameter of the secondary-transfer opposed roller 136 is, for example, approximately 24 mm. The diameter of the metal cored bar of the secondary-transfer opposed roller 136 is approximately 16 mm. Specific preferred materials suitable for the resistance layer include, but are not limited to, polycarbonate, fluorine-based rubber, silicon rubber, and the like in which conductive particles such as carbon and metal complex are dispersed, or rubbers such as nitrile rubber (NBR) and Ethylene Propylene Diene Monomer (EPDM), rubber of NBR/ECO copolymer, and semiconductive rubber such as polyurethane. The volume resistivity of the resistance layer is in a range from $10^{6}\Omega$ to $10^{12}\Omega$, more preferably, in a range from $10^{7}\Omega$ to $10^{9}\Omega$.

The resistance layer may be a foam-type having a hardness in a range from 20 degrees and 50 degrees on Asker C hardness scale or a rubber-type having a hardness in a range from 30 degrees and 60 degrees on Asker C hardness scale. Since the secondary-transfer opposed roller 136 contacts the secondary transfer roller 135 via the intermediate transfer belt 131, the sponge-type layer is preferred because it allows the secondary-transfer opposed roller 136 to reliably contact the secondary transfer roller 135 via the intermediate transfer belt 131 even with a low contact pressure. After the secondary transfer process, that is, after the intermediate transfer belt 131 passes through the secondary transfer nip N, the residual toner not having been transferred onto the recording medium P remains on the intermediate transfer belt 131. The residual toner is removed from the intermediate transfer belt 131 by a cleaning blade of the belt cleaning device 138 which contacts the surface of the intermediate transfer belt 131.

The fixing unit 14 employs a belt fixing method and includes a fixing belt 141 formed into an endless loop, a fixing roller 143, a heating roller 144, and a pressing roller 142 that is pressed against the fixing belt 141. The fixing belt 141 is looped around the fixing roller 143 and the heating roller 144. One of the fixing roller 143 and the heating roller 144 includes a heat source such as a heater, a lamp, and an electromagnetic induction type heating device. The fixing belt 141 is interposed between the fixing roller 143 and the pressing roller 142 and pressingly contacts the fixing roller 143, thereby forming a heated area called a fixing nip between the fixing belt 141 and the pressing roller 142.

In the image forming apparatus 1, based on image information read by the image reader 10 or provided by external devices such as a personal computer (PC), the exposure device 113 forms electrostatic latent images on each of the photoconductors 112S, 112Y, 112M, 112C, and 112K. The electrostatic latent images on the photoconductors 112S, 112Y, 112M, 112C, and 112K are developed with toners of respective colors by the developing devices 114S, 114Y, 114M, 114C, and 114K into visible images or also known as toner images. The toner images are transferred onto the intermediate transfer belt 131 in a process known as primary transfer. For example, a special color toner image formed on the surface of the photoconductor 112S enters the primary transfer nip as the photoconductor 112S rotates.

Subsequently, the special color toner image is primarily transferred from the photoconductor 112S to the intermediate transfer belt 131 by the transfer electric field and the nip pressure. Then, the intermediate transfer belt 131, on which the special color toner image has been transferred, passes through the primary transfer nips of yellow, magenta, cyan, and black, accordingly. The yellow, magenta, cyan, and black toner images on the photoconductors 112Y, 112M, 112C, and 112K are primarily transferred such that they are superimposed one atop the other on the special color toner image which has been transferred on the intermediate transfer belt 131, thereby forming a composite toner image on the intermediate transfer belt 131 in the primary transfer process. With this configuration, the composite toner image including the special color toner image and the color toner images other than the special color toner image is formed on the intermediate transfer belt 131 in the primary transfer process.

The composite toner image is secondarily transferred onto a recording medium P fed from the paper feed unit 12 at appropriate timing in a process known as secondary transfer. After the secondary transfer, the recording medium P, onto which the composite color toner image is transferred, is transported to the fixing unit 14. The recording medium P bearing an unfixed toner image on the surface thereof is delivered to the fixing nip at which the surface of the recording medium P bearing the unfixed toner image tightly contacts the fixing belt 141 in the fixing unit 14. Under heat and pressure, the toner adhered to the toner image is softened and fixed to the recording medium P in the fixing nip in the fixing unit 14.

The recording medium P is discharged onto the exterior of the image forming apparatus 1. In the event of duplex printing in which an image is formed on the other side or the second side of the recording medium P opposite to the surface on which the toner image has been fixed, the recording medium P is delivered to a sheet reversing device in which the recording medium P is reversed after the fixing process. Subsequently, similar to the above-described image forming process, a toner image is formed on the other side of the recording medium P. The recording medium P, on which the toner image is fixed in the fixing unit 14, is output onto an output tray 151 via an output roller 152 of the paper output unit 15 from the main body 2 of the image forming apparatus 1.

In order to facilitate an understanding of the novel features of the present disclosure, as a comparison, a description is provided of a comparative example of the image forming apparatus.

In order to prevent toner dropouts in the secondary transfer process without deformation of an output image and aggravation of the motor torque irrespective of the special color toner and a type of paper, it is generally known that the following approaches are effective. First, a lubricant is applied to a surface of a medium (e.g., a photoconductor and an intermediate transfer belt) prior to transfer process to lower the friction coefficient With this configuration, the adhesive force between the medium and toner is reduced prior to transfer process, hence preventing toner dropouts. Second, when a moving speed (liner velocity) of the surface of the medium (e.g., a photoconductor and an intermediate transfer belt) prior to transfer process is different from that after transfer process, a shear force acts on the toner layer to transfer the toner.

Although advantageous and generally effective for its intended purpose, there is a drawback in the above-described approaches. First, application of the lubricant to the intermediate transfer belt to reduce the adhesive force between the intermediate transfer belt and the toner can improve toner dropouts in the secondary transfer process. However, the friction coefficient $\mu$ is low in a primary transfer process, which is disadvantageous for toner dropouts. Furthermore, in a case in which the toner adhesion amount is relatively large such as when using the special color toner, toner dropouts are not reduced sufficiently. Second, with different moving speeds (linear velocities) between the surface of the intermediate transfer belt and the recording medium to reduce toner dropouts in the secondary transfer, the output image stretches or shrinks in a sub-scanning direction. Furthermore, with different moving speeds, the torque of a motor for driving the intermediate transfer belt and a motor for driving a secondary transfer roller is aggravated.

Furthermore, in this approach, it is necessary to set the moving speed of the intermediate transfer belt approximately 1.002 to 1.02 times the moving speed of the photoconductor, and to set a contact pressure (transfer pressure) between the photoconductor and the intermediate transfer belt to 10 g/cm to 70 g/cm. In this configuration, although toner dropouts and a transfer failure may be prevented while maintaining the transfer rate, toner dropouts are still not prevented in the secondary transfer process when using paper having a high smoothness and a low friction coefficient t. Since the moving speeds of the photoconductor and the intermediate transfer belt are different from each other, stretch and shrinkage of the output image occur, and the motor torque is aggravated.

Furthermore, when secondarily transferring toner images of multiple colors including the special color toner image, a superimposed bias is output. By contrast, when secondarily transferring toner images having no special color toner image, a direct current bias is output.

In view of the above, there is thus an unsolved need for an image forming apparatus capable of preventing toner dropouts in the secondary transfer process without deformation of an output image and aggravation of the motor torque irrespective of the special color toner and a type of paper.

Figure 2B:
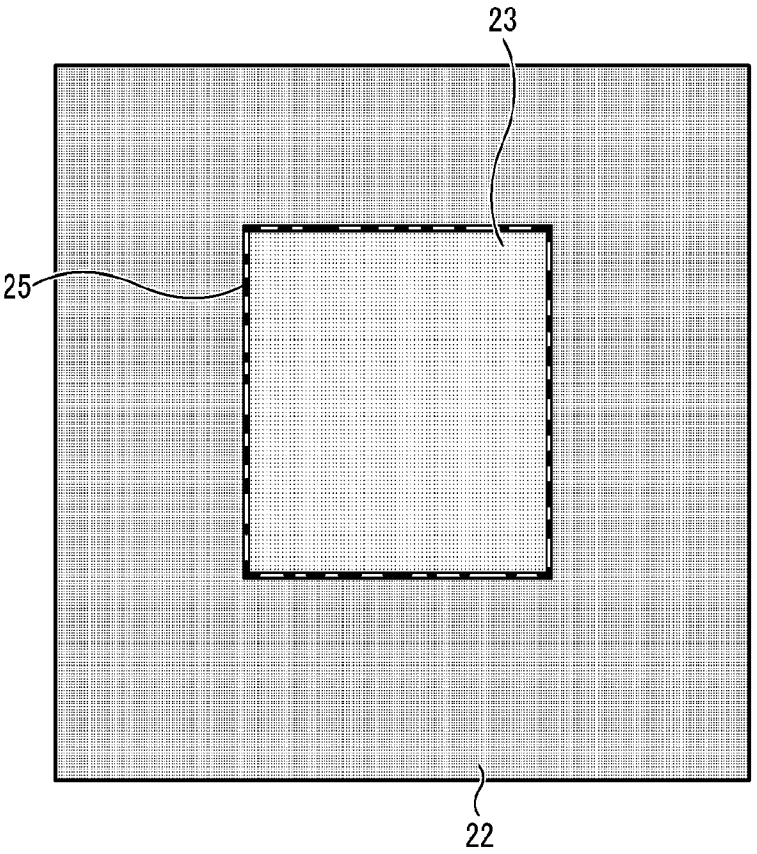
FIG. 2B is a plan view of FIG. 2A.
Figure 2A:
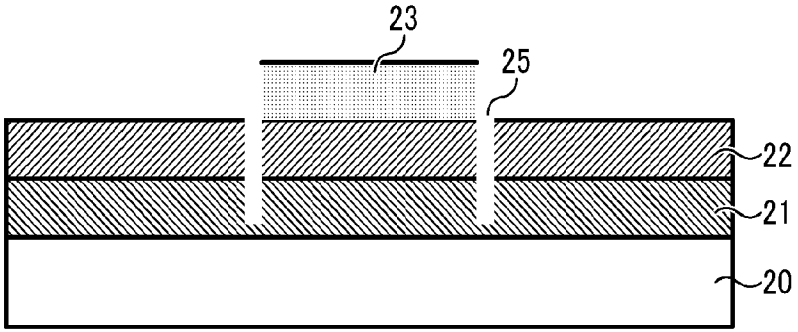
FIG. 2A is a cross-sectional diagram schematically illustrating an example of an image with toner dropouts (blank spots)

With reference to FIGS. 2A and 2B, a description is provided of mechanisms of toner dropouts. FIG. 2A is a cross-sectional diagram schematically illustrating an example of an image with toner dropouts (blank spots). FIG. 2B is a plan view of FIG. 2A. FIG. 2A illustrates an image formed on a white sheet 20.

More specifically, a cyan toner layer 21 and a magenta toner layer 22 are superimposed one atop the other on a whole surface of the white sheet 20. A transparent toner layer 23 is superimposed on the solid image as a background, thereby forming a solid patch image. In such an image, in some cases, a partial toner deficiency in the magenta toner layer 22 and the cyan toner layer 21 occurs linearly and in a dot shape near a periphery 25 of the transparent toner layer 23. Such a partial deficiency of toner is hereinafter referred to as toner dropouts. As compared with a normal color image, when the special color toner is superimposed on a full-color image, the toner adhesion amount increases. As a result, the edge effect in development further increases the toner adhesion amount at the edge portion of the patch image of the special color. The pressure at the transfer process causes toner particles to aggregate more easily at the end portion of the patch image. In particular, in a high-temperature, high-humidity environment, toner particles aggregate more easily, hence aggravating toner dropouts.

Next, a description is provided of a configuration to prevent such toner dropouts.

First, a description is provided of experiments performed by the present inventors. A test machine having a configuration similar to the image forming apparatus 1 was used in the experiments. More specifically, a partially modified image forming apparatus "RICOHProC751EX" manufactured by Ricoh Co., Ltd. was used as the test machine. What is partially modified includes an image forming unit that forms and outputs the toner image of special color such as a clear toner and a white toner. Various printing tests were performed using the test machine.

A solid blue image formed of the cyan toner and the magenta toner such as shown in FIG. 2A was formed as a background on a whole surface of the white paper, and the solid patch was formed with the special color toner on the solid blue image. A transparent and colorless, clear toner was employed as the special color toner. As a developing agent for cyan and magenta, a toner (i.e., polymerization toner) having an average particle diameter of approximately 5.2 μm, produced using polymerization was used. As a developing agent for the special color, a toner (i.e., a pulverized toner) having an average particle diameter of approximately 6.8 μm, produced using pulverization was used. In the print tests, magnetic carriers having an average particle diameter of 55 μm,coated with a resin layer were used.

In general, with an increase in the particle diameter, a contact area relative to the photoconductor and the intermediate transfer belt increases, thereby increasing a non-electrostatic adhesive force, which is disadvantageous for toner dropouts. The special color toner used in the experiments was a pulverized toner having the particle diameter greater than that of the color polymerization toner. Thus, toner dropouts occur easily.

Figure 3:
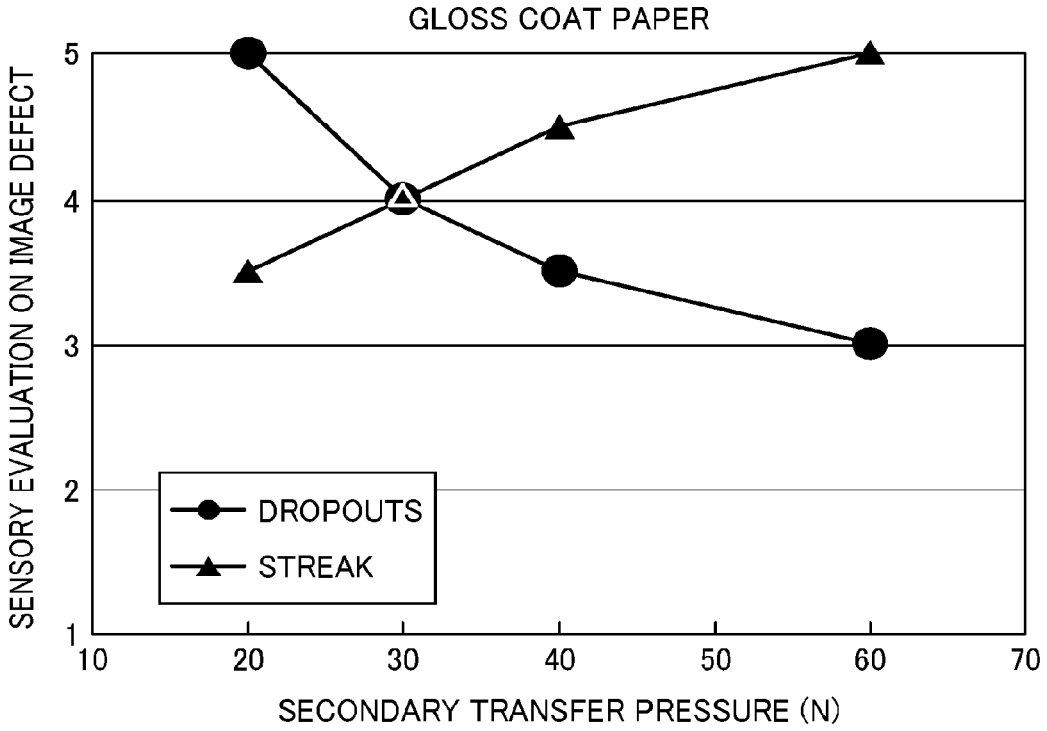
FIG. 3 is a graph showing relations between a secondary transfer pressure and image defects such as toner dropouts and horizontal black streaks on gloss coated paper.
Figure 4:
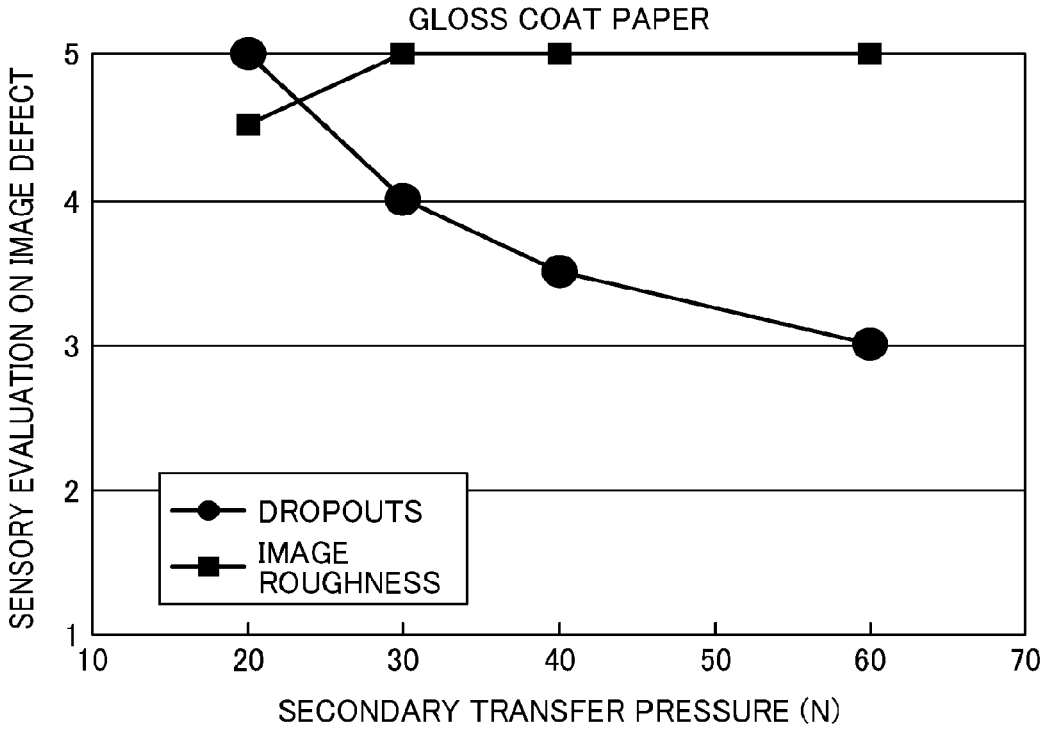
FIG. 4 is a graph showing relations between the secondary transfer pressure and image defects such as toner dropouts and image roughness on gloss coated paper.
Figure 5:
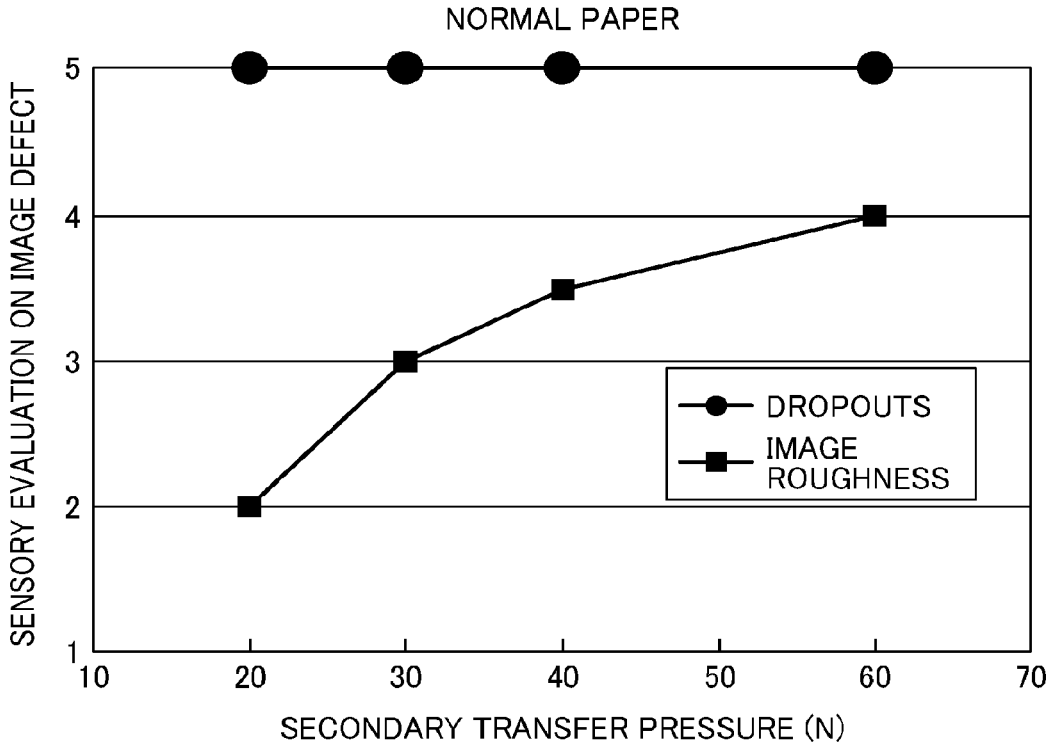
FIG. 5 is a graph showing relations between the secondary transfer pressure and image defects such as toner dropouts and image roughness on regular paper.

FIGS. 3 through 5 show results of sensory evaluations on black horizontal streaks and image roughness in an image with toner dropouts and a halftone image derived from a transport failure of the recording medium while changing the secondary transfer pressure. For test paper, regular paper with a smoothness of 50 s and a sheet basis weight of 68 $g/m^2$, and highly-smooth paper, that is, gloss coated paper with a smoothness of 820 s and a sheet basis weight of 128 $g/m^2$ were used in the experiments. The tests were performed under laboratory atmospheric conditions at 27° C. and 80% RH. The toner adhesion amount on the intermediate transfer belt to be detected by the toner detector 137 was 0.45 $mg/cm^2$ for each color. In the sensory evaluations, a predetermined human evaluator having normal eyesight visually observed and graded boundary samples of image defects including toner dropouts and horizontal black streaks. When the grade was 4 or above in the sensory evaluation, the image defects (i.e., toner dropouts, image roughness, and horizontal black streak) were improved to a level at which the image defects did not stand out.

The toner dropouts at the periphery 25 of the transparent toner shown in FIG. 2 were evaluated. The image roughness was evaluated on the solid blue image formed on the whole surface of the test sheet. The horizontal black streaks were evaluated on a halftone black image. It is to be noted that the secondary transfer pressure herein refers to a sum of loads at two points (front and rear) in the axial direction of the secondary transfer roller 135.

As illustrated in FIG. 3, with a relatively low secondary transfer pressure, the toner dropouts tend to decrease around the transparent toner portion (around the special color toner portion) on highly smooth paper such as gloss coated paper. However, the black horizontal streaks tend to become worse. It is to be noted that the horizontal black streaks attributed to transportability of a recording medium are more pronounced on paper with a low degree of surface roughness, i.e., paper with a smooth surface than paper with a high degree of surface roughness. Therefore, the horizontal black streaks are evaluated only on the gloss coated paper.

According to the evaluation results shown in FIG. 3, depending on the use of special color toner, the secondary transfer pressure is changed. More specifically, when the special color toner is used the secondary transfer pressure is changed to prevent toner dropouts. When no special color toner is used, the secondary transfer pressure is changed to prevent horizontal black streaks.

As illustrated in FIG. 4, with a relatively low secondary transfer pressure, the toner dropouts tend to decrease on highly smooth paper such as gloss coated paper. However, the image roughness tends to get aggravated slightly. Since the paper with a high smoothness has a relatively low degree of surface roughness, the image roughness is aggravated only slightly even when the secondary transfer pressure is lower than normal. With this configuration, the compression of toner due to pressure at secondary transfer is reduced, hence preventing toner dropouts.

As compared with the gloss coated paper, with regards to regular paper having a relatively low smoothness, as illustrated FIG. 5, toner dropouts do not occur at the secondary transfer pressure of 60 N. However, as the secondary transfer pressure is reduced, the image roughness is aggravated significantly because of the roughness of the surface of the paper. In other words, when using regular paper, the toner dropouts do not occur without reducing the secondary transfer pressure. Both toner dropouts and image roughness can be reduced at the secondary transfer pressure of 60 N, if not prevented entirely. As described above, in accordance with a type of paper or smoothness (surface friction coefficient) of paper, the secondary transfer pressure is changed to prevent toner dropouts and image roughness, thereby obtaining a favorable image without transfer failure.

Figure 6:
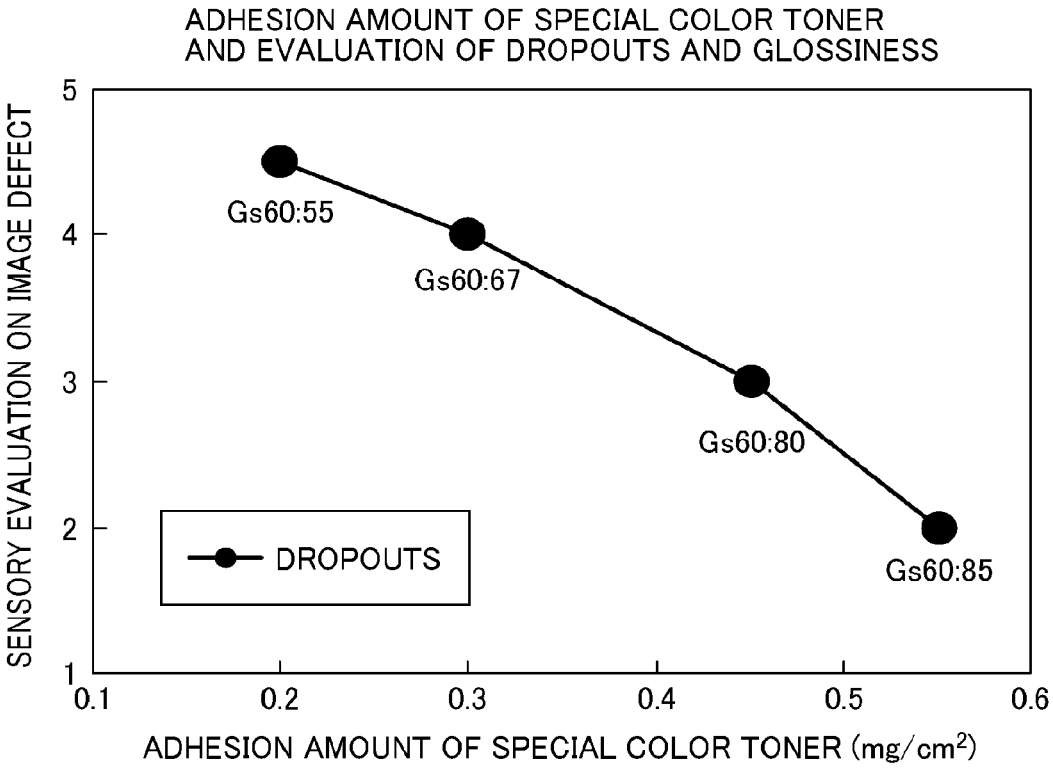
FIG. 6 is a graph showing relations between a toner adhesion amount of a special color toner, toner dropouts, and glossiness on gloss coated paper.

FIG. 6 shows results of sensory evaluations on toner dropouts and glossiness with different toner adhesion amounts of the special color toner using the above-described test machine. For evaluation paper, gloss coated paper with a smoothness of 820 s and a sheet basis weight of 128 g/m$^2$ was used. The test environment and the evaluations of the toner dropouts are the same as that of the experiments shown in FIGS. 3 through 5. The glossiness was measured on the transparent toner layer 23 of the image shown in FIG. 2A using a gloss meter PG-1M manufactured by NIPPON DENSHOKU INDUSTRIES Co., LTD. The gloss measurement angle was a general 60-degree gloss Gs. As illustrated in FIG. 6, as the toner adhesion amount of the special color toner decreases, the toner dropouts improve. However, the glossiness of the special color toner decreases.

Table 1 shows optimal values of the secondary transfer pressure at which grades on both toner dropouts and image roughness are 4 or above under different operating environments.

The toner dropouts tend to aggravate in a high-temperature, high-humidity environment in which toner particles aggregate easily. Therefore, the toner dropouts and image roughness are prevented from aggravating depending on the sheet type and the operating environment by referencing a table such as Table 1 based on a type of paper and a present environment. It is to be noted that the "present environment" includes, but is not limited to a low-temperature, low-humidity (L/L) environment (10° C., 15%), a medium-temperature, medium-humidity (M/M) environment (23° C., 50%), and a high-temperature, high-humidity (H/H) environment (27° C., 0%). The combination of the temperature and the humidity is not limited to the above.

TABLE 1

| | PRESENT ENVIRONMENT | | |
|---|---|---|---|
| PAPER TYPE/SMOOTHNESS | H/H | M/M | L/L |
| REGULAR/50 s | 60N | 60N | 60N |
| MATT COATED/300 [s] | 50N | 60N | 60N |
| GLOSS COATED (A)/820 [s] | 30N | 40N | 60N |
| GLOSS COATED (B)/12800 [s] | 20N | 30N | 60N |

Figure 7:
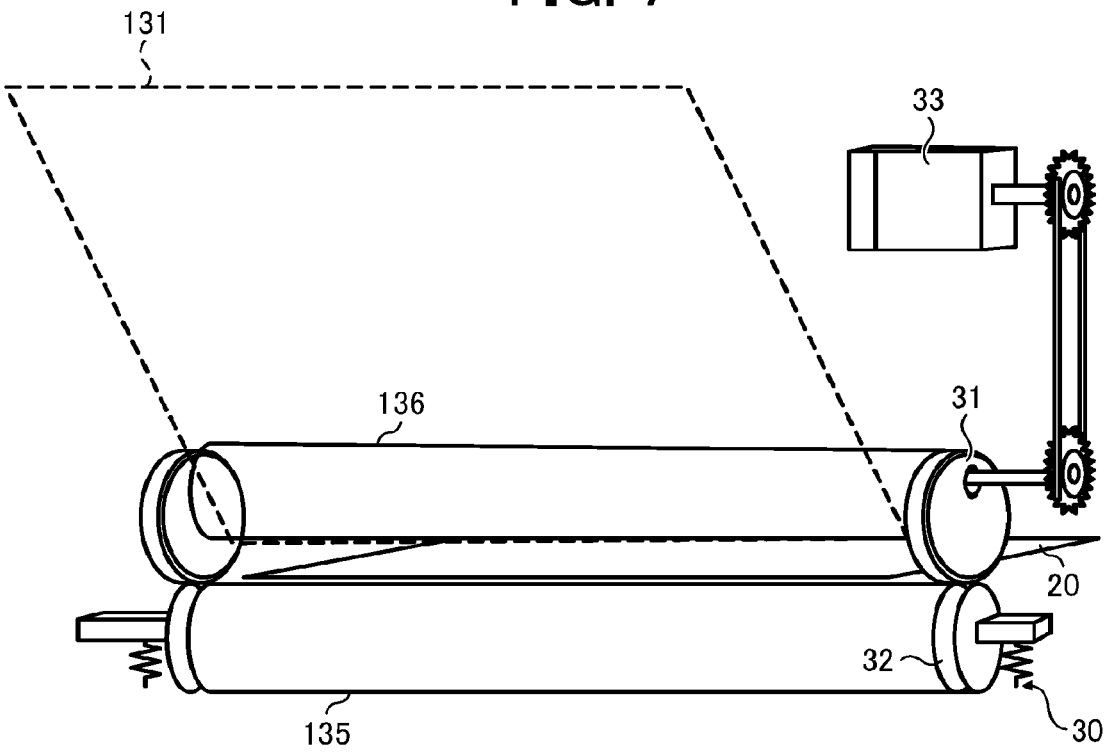
FIG. 7 is a schematic diagram illustrating an example of a secondary transfer pressure adjuster employed in the image forming apparatus according to an illustrative embodiment of the present disclosure.

With reference to FIG. 7, a description is provided of an example of a secondary transfer pressure adjuster employed in the image forming apparatus 1 according to an illustrative embodiment of the present disclosure. The secondary transfer roller 135 is disposed opposite the secondary-transfer opposed roller 136 via the intermediate transfer belt 131. The secondary transfer roller 135 is biased against the secondary-transfer opposed roller 136 by a biasing device 30. The biasing device 30 includes, but is not limited to, a compression spring and a tension spring. The biasing device 30 applies a predetermined secondary transfer pressure to a recording medium P and the intermediate transfer belt 131. An eccentric cam 31 is disposed at both ends of the secondary-transfer opposed roller 136 in an axial direction of the secondary-transfer opposed roller 136, coaxially on the same shaft as the secondary-transfer opposed roller 136. A ball bearing 32 is disposed at both ends of the secondary transfer roller 135 in an axial direction of the secondary transfer roller 135 in such a manner that the ball bearings 32 do not hinder rotation of the secondary transfer roller 135. The ball bearings 32 contact the eccentric cams 31. In accordance with the position of the eccentric cams 31, the secondary transfer pressure is adjusted. Rotation of the shaft on which the eccentric cam 31 is mounted is controlled freely by a stepping motor 33, and the rotation of the stepping motor 33 is transmitted via gears and a timing belt to the shaft on which the eccentric cam 31 is mounted.

Although FIG. 7 illustrates an example of the secondary transfer pressure adjuster, the secondary transfer pressure adjuster is not limited to the configurations illustrated in FIG. 7. Alternatively, in some embodiments, a simple adjustment of the secondary transfer pressure is also possible by replacing the spring of the biasing device 30. This configuration does not require the eccentric cam 31 and the stepping motor 33, thereby reducing the cost.

Figure 8:
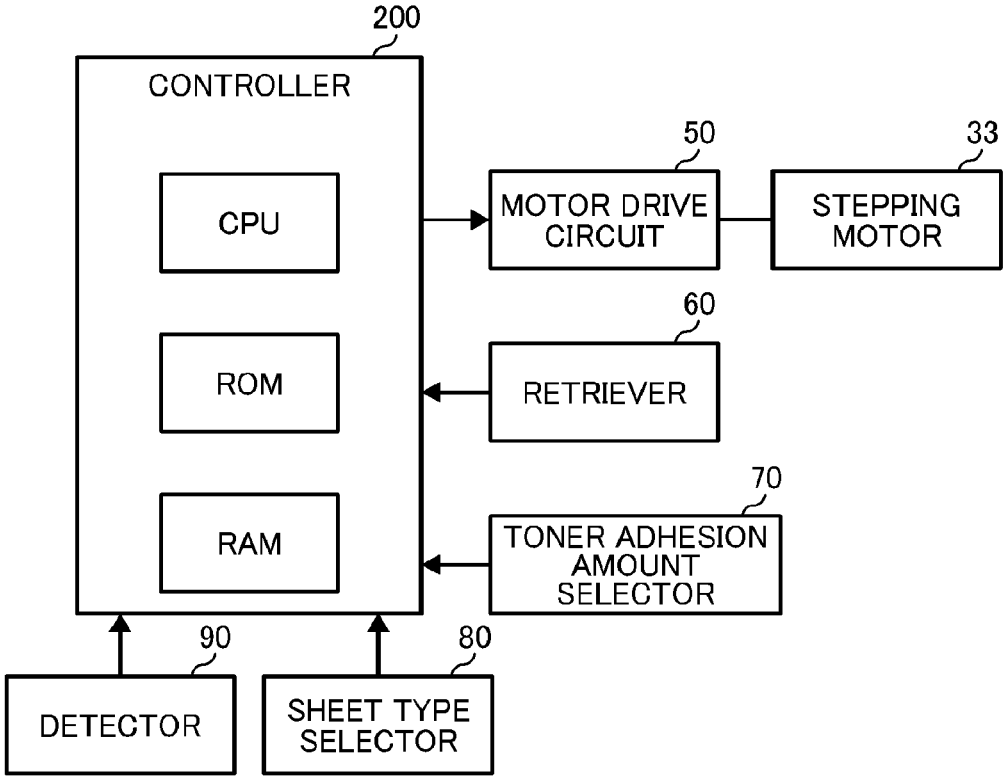
FIG. 8 is a block diagram illustrating a control system of a controller that controls various operations including an image reading operation and an image forming operation according to an illustrative embodiment of the present disclosure.

FIG. 8 is a block diagram illustrating a control system of a controller 200 that controls various operations of the image forming apparatus 1 including an image reading operation and an image forming operation according to an illustrative embodiment of the present disclosure. The controller 200 includes a central processing unit (CPU) to carry out control programs, a Read Only Memory (ROM) to store the control programs, and a Random Access Memory (RAM) to allow the control programs to be read and to temporarily store data.

A description will be given of only configurations of the controller 200 associated with the adjustment of the secondary transfer pressure. In an initial state, information on the eccentric cam 31 for setting the predetermined secondary transfer pressure is preinstalled in the ROM. The controller 200 controls, via a motor drive circuit 50, the stepping motor 33 that operates the eccentric cam 31, thereby controlling rotation of the eccentric cam 31 and hence adjusting the secondary transfer pressure according to the illustrative embodiment of the present disclosure.

Furthermore, a retriever 60, a toner adhesion amount selector 70, and a sheet type selector 80 are connected to the controller 200. The retriever 60 obtains data of an image read by the image reader 10 or data of an input image input by the external device such as a personal computer (PC). The toner adhesion amount selector 70 allows users to select a maximum amount of toner adhesion. The sheet type selector 80 allows users to select a type of a recording medium. The operation panel of the image forming apparatus includes the toner adhesion amount selector 70 and the sheet type selector 80.

Although FIG. 8 illustrates the stepping motor 33 for adjustment of the secondary transfer pressure to describe the characteristic features of the present disclosure, the controller 200 not only controls the motor drive circuit 50, hence the stepping motor 33, but also controls overall functions of the image forming apparatus 1.

Figure 9:
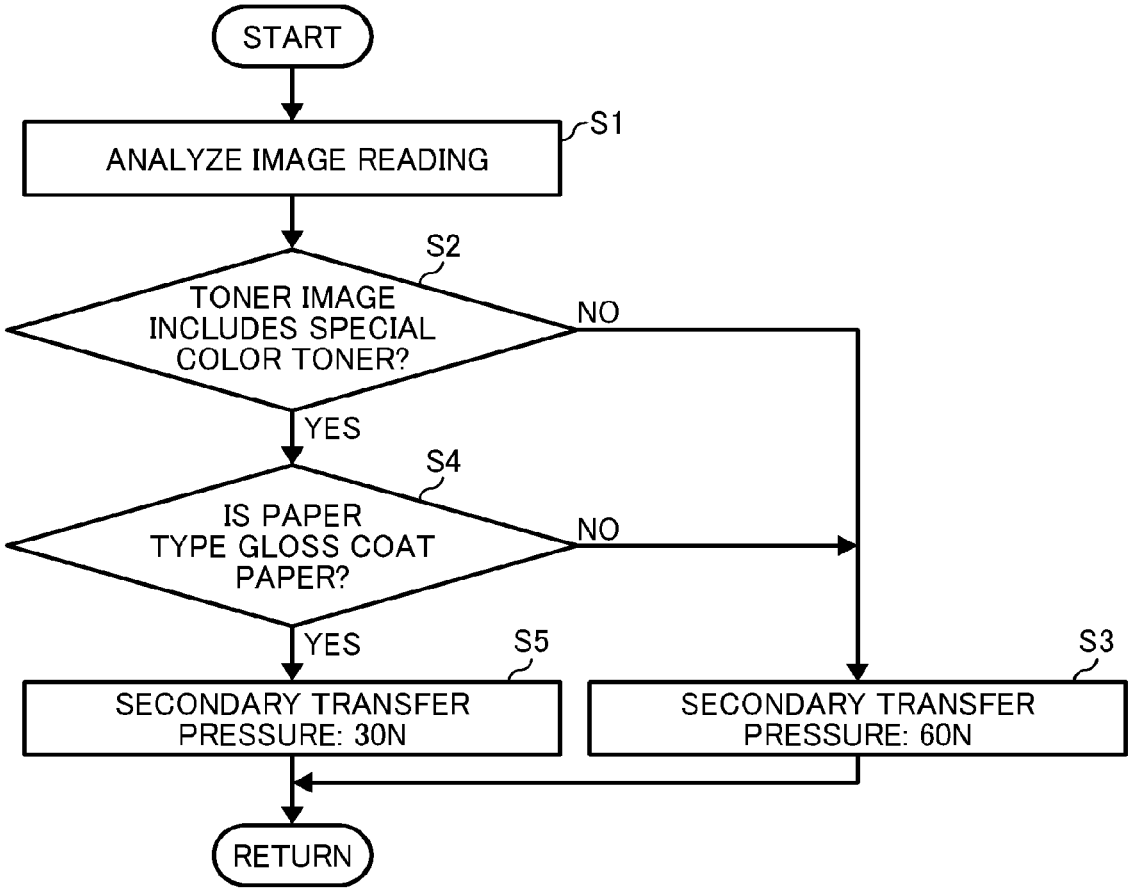
FIG. 9 is a flowchart illustrating a procedure for preventing the toner dropouts according to an illustrative embodiment of the present disclosure.

With reference to FIG. 9, a description is provided of an example of a procedure for preventing the toner dropouts according to an illustrative embodiment of the present disclosure. FIG. 9 is a flowchart showing control steps by the controller 200.

First, at step S1, the controller 200 analyzes an image read by the image reader 10 or an input image provided by an external device such as a personal computer (PC) or the like. Next, at step S2, based on the result of the analysis, the controller 200 determines whether or not a toner image formed in accordance with the scanned image or the input image includes a special color toner. If the toner image does not include the special color toner (No at step S2), the controller 200 does not reduce the secondary transfer pressure, and determines a rotation angle of the stepping motor 33 such that the stepping motor 33 drives the secondary transfer roller 135 at a normal secondary transfer pressure at step S3. If the toner image includes the special color toner (Yes at step S2), a type of a recording medium to be used is determined at step S4. If the type of the recording medium is not paper with a high smoothness (No at step 4), the controller 200 does not reduce the secondary transfer pressure, and determines a rotation angle of the stepping motor 33 such that the stepping motor 33 drives the secondary transfer roller 135 at a normal secondary transfer pressure at step S3. If the type of the recording medium is paper with a high smoothness (Yes at step 4), the controller 200 reduces the secondary transfer pressure at step 5 to prevent toner dropouts.

Additionally, in some embodiments, the secondary transfer pressure is adjusted in consideration of the operating environment. It is to be noted that a method to identify one of the types and the smoothness includes, but is not limited to a direct selection method in which users select one of the type and the smoothness of a recording medium using an operation panel of the image forming apparatus. In other words, the image forming apparatus 1 includes a selecting device to select one of the type and smoothness of the recording medium is provided.

Alternatively, a contact-free detector 90 may be employed to detect one of the type and the smoothness of the recording medium. Furthermore, in some embodiments, the detector 90 serves as a sheet identifying detector that automatically identify the sheet type. For example, a recording medium as an identification target is irradiated with light projected from a light source such as a light emitting diode (LED), and the name or the like of the recording medium is identified based on the light intensity of the light reflected from the recording medium.

Furthermore, the operation panel allows users to select forcibly the toner adhesion amount of the special color toner and to specify the operating environment setting. In other words, the image forming apparatus 1 includes a selector to select a toner adhesion amount of the special color toner.

According to the present illustrative embodiment, in a case in which the image includes a special color toner, the maximum toner adhesion amount of the image is greater than the maximum toner adhesion amount of each of the colors yellow, magenta, cyan, and black. (The toner adhesion amount is determined by setting an exposure intensity of the exposure device and a developing bias of the developing device.) When transferring a toner image including a special color toner having a large toner adhesion amount at secondary transfer, toner dropouts occur more easily than when transferring a toner image having no special color toner. In view of the above, when transferring a toner image including a special color toner, the secondary transfer pressure is reduced to prevent effectively toner dropouts.

[Embodiment 2]

Figure 10:
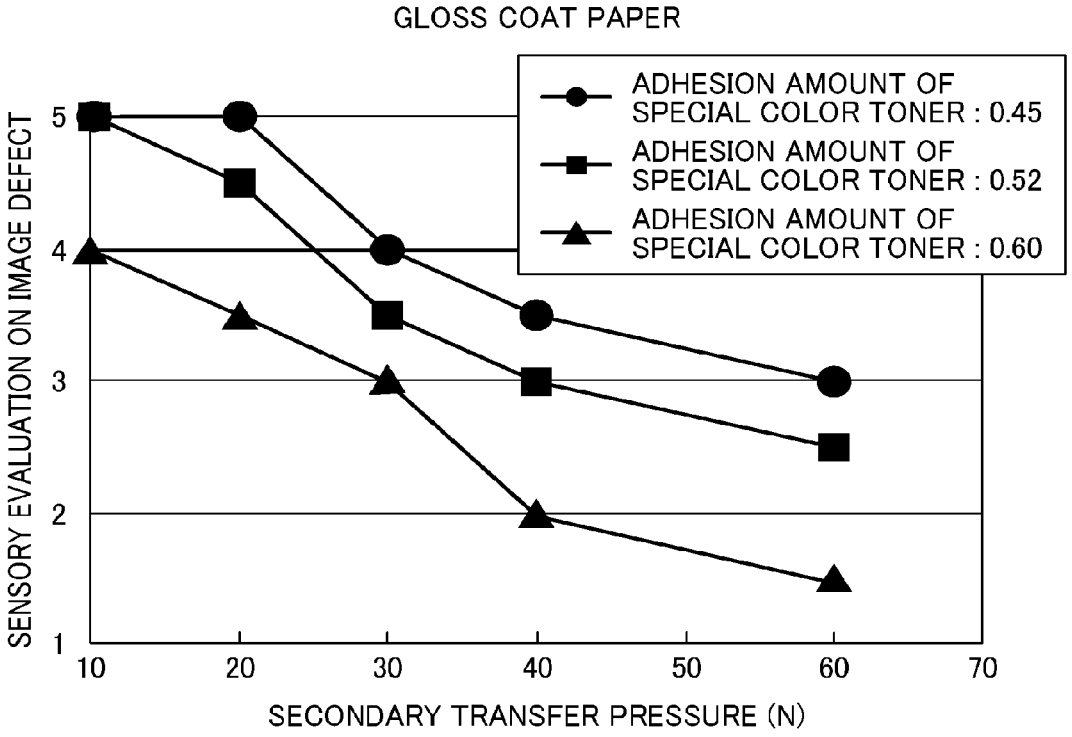
FIG. 10 is a graph showing relations between the toner adhesion amount of the special color toner, the secondary transfer pressure, and toner dropouts on gloss coated paper.

FIG. 10 shows results of sensory evaluations on toner dropouts with different toner adhesion amounts of the special color toner and different secondary transfer pressures. For evaluation paper, gloss coat paper with a smoothness of 820 s and a sheet basis weight of 128 g/m$^2$ was used. The test environment and images for the evaluation of the toner dropouts were the same as that of the experiments shown in FIGS. 3 through 5. The toner adhesion amount of the process colors (yellow, magenta, cyan, and black) detected by the toner adhesion amount detector 137 was constant, i.e., 0.45 mg/cm$^2$. The toner adhesion amount of the special color toner was set greater than that of the process colors. More specifically, the toner adhesion amount of the special color toner was changed between 0.45 mg/cm$^2$ and 0.60 mg/cm$^2$.

As illustrated in FIG. 10, as the toner adhesion amount of the special color toner increases, grades on the toner dropouts tend to get worse. The evaluation improves as the secondary transfer pressure is reduced. When the secondary transfer pressure is relatively low, for example, at 20N, the evaluation of the toner dropouts improves to grade 5 with the toner adhesion amount of the special color toner of 0.45 mg/cm$^2$. By contrast, when the toner adhesion amount of the special color toner is 0.60 mg/cm$^2$, the grade of the evaluation is 3.5, which is worse than when the toner adhesion amount of the special color toner is 0.45 mg/cm$^2$.

Table 2 shows secondary transfer pressures at which the grade on the image is 4 or above. As Table 2 shows, the evaluation of the image improves to 4 or above by reducing the secondary transfer pressure as the toner adhesion amount of the special color toner increases.

TABLE 2

| TONER ADHESION AMOUNT OF SPECIAL COLOR TONER [mg/cm$^2$] | SECONDARY TRANSFER PRESSURE [N] |
|---|---|
| 0.45 | 30 |
| 0.52 | 20 |
| 0.60 | 10 |

Figure 11:
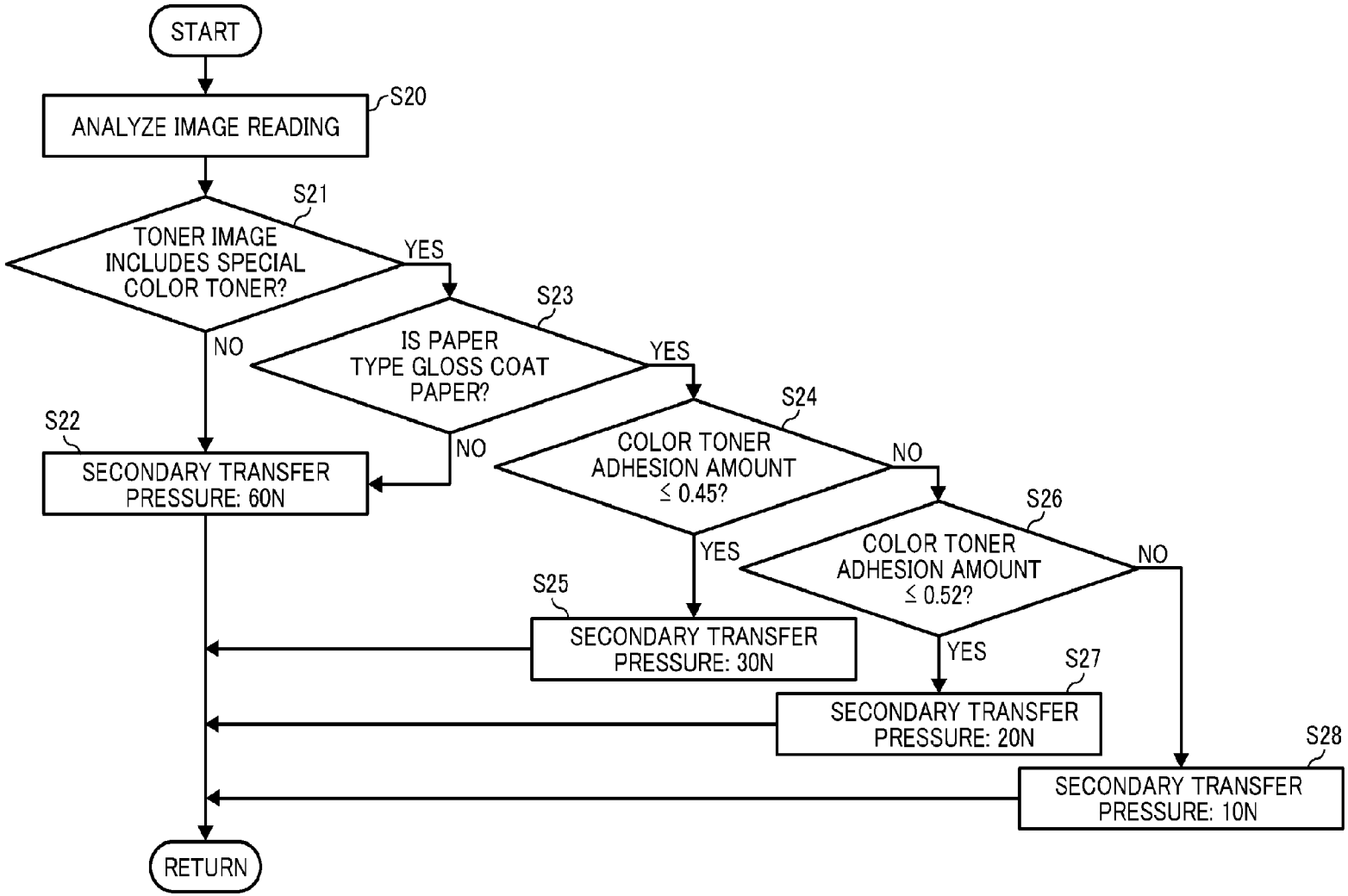
FIG. 11 is a flowchart illustrating a procedure for control of the secondary transfer pressure when the toner adhesion amount of the special color toner is increased according to an illustrative embodiment of the present disclosure.

With reference to FIG. 11, a description is provided of an example process for adjustment of the secondary transfer pressure based on the example shown in Table 2 when the toner adhesion amount of the special color toner increases.

First, at step S20, the controller 200 analyzes an image read by the image reader 10 or an input image provided by an external device such as a personal computer (PC) or the like. Next, at step S21, based on the result of the analysis at step S20, the controller 200 determines whether or not a toner image formed in accordance with the read image or the input image includes a special color toner. If the toner image does not include the special color toner (No at step S21), the controller 200 does not reduce the secondary transfer pressure, and determines a rotation angle of the stepping motor 33 such that the stepping motor 33 drives the secondary transfer roller 135 at a normal secondary transfer pressure at step S22.

If the toner image includes the special color toner (Yes at step S21), a type of a recording medium to be used is determined at step S23. If the type of the recording medium is not paper with a high smoothness (No at step 23), the controller 200 does not reduce the secondary transfer pressure, and determines a rotation angle of the stepping motor 33 such that the stepping motor 33 drives the secondary transfer roller 135 at a normal secondary transfer pressure at step S22.

If the paper type is paper with a high smoothness (Yes at step S23), the controller 200 determines whether or not the toner adhesion amount of the special color toner is equal to or less than 0.45 mg/cm$^2$ at step S24. If the toner adhesion amount of the special color toner is equal to or less than 0.45 mg/cm$^2$ at step S24 (Yes at step S24), the controller 200 reduces the secondary transfer pressure to 30 N, which is lower than a normal pressure, at step S25.

If the toner adhesion amount of the special color toner is greater than 0.45 mg/cm$^2$ at step S24 (No at step S24), the controller 200 determines whether or not the toner adhesion amount of the special color toner is equal to or less than 0.52 mg/cm$^2$ at step S26. If the toner adhesion amount of the special color toner is equal to or less than 0.52 mg/cm$^2$ at step S26 (Yes at step S26), the controller 200 reduces the secondary transfer pressure to 20 N at step S27.

If the toner adhesion amount of the special color toner is greater than 0.52 mg/cm$^2$ at step S26 (No at step S26), the controller 200 reduces the secondary transfer pressure to 10 N at step S28. Accordingly, adjusting the secondary transfer pressure in accordance with the toner adhesion amount of the special color toner as described above can prevent toner dropouts. According to the present illustrative embodiment, threshold values of the toner adhesion amount of the special color toner include 0.45 m g/cm$^2$, 0.52 mg/cm$^2$, and 0.60 mg/cm$^2$. However, the threshold values are not limited thereto. The secondary transfer pressure is divided into four groups. However, the number of groups is not limited to four. Alternatively, the secondary transfer pressure may be divided into more groups or fewer groups.

[Embodiment 3]

In Embodiment 2, the toner adhesion amount of the special color toner is obtained by the controller 200 serving as a toner adhesion calculator based on a read image or an input image. Alternatively, a maximum value of the toner adhesion amount (that is, the toner adhesion amount when a solid image is formed) can be selected from the toner adhesion amount selector 70 of an operation panel of the image forming apparatus 1. The secondary transfer pressure is adjusted such that the lower is the selected toner adhesion amount, the lower is the secondary transfer pressure. According to Embodiment 3, adjusting the secondary transfer pressure in accordance with the maximum value of the toner adhesion amount of the special color toner selected by users can effectively prevent toner dropouts.

According to the illustrative embodiments, the present disclosure is applied to a tandem-type image forming apparatus such as illustrated in FIG. 1 that forms toner images of different colors on the respective photoconductors. However, the image forming apparatus is not limited to the tandem-type image forming apparatus. The present disclosure can be applied to an image forming apparatus that transfers a composite toner image onto an intermediate transfer belt and an intermediate transfer drum. For example, the present disclosure can be applied to an image forming apparatus in which a single-color toner image is formed on a single photoconductor and is transferred onto an intermediate transfer body. This transfer process is repeated for the number of given colors.

According to the present disclosure, when printing an image with a special color toner superimposed on color toners, the secondary transfer pressure is reduced lower than that when printing a normal color image without the special color toner, having the same toner adhesion amount. Accordingly, compression of the toner is prevented when pressure is applied to the toner upon secondary transfer, hence preventing toner dropouts.

If the secondary transfer pressure is lowered, the recording medium is not reliably held at the secondary transfer nip, causing unstable transportation of the recording medium. As a result, the recording medium picks up vibration that was generated when the recording medium exited the pair of registration rollers prior to the secondary transfer, and improper transfer occurs at the secondary transfer nip. More specifically, image defects such as horizontal black streaks are produced in a halftone image.

In view of the above, in the event in which the special color toner is not used, the normal secondary transfer pressure is employed to prevent horizontal black streaks. It is preferable that the secondary transfer pressure be relatively high to prevent image roughness. In other words, depending on the use of special color toner, the secondary transfer pressure is changed to prevent toner dropouts while maintaining transportability of the recording medium.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image forming station to form a toner image;

an intermediate transfer body onto which the toner image formed by the image forming station is transferred;

a transfer device to transfer the toner image from the intermediate transfer body onto a recording medium in a transfer nip;

a transfer pressure applicator to apply a secondary transfer pressure to the transfer nip upon transfer of the toner image to the recording medium; and a controller, operatively connected to the transfer pressure applicator, to determine whether the toner image is a first image including a special color toner or a second image consisting of a toner other than the special color toner, and to control the transfer pressure applicator to apply a first pressure upon transfer of the first image and apply a second pressure upon transfer of the second image, the first pressure being lower than the second pressure, wherein the special color toner is a pulverized toner, and a toner other than the special color toner included in the toner image is a polymerization toner.

2. The image forming apparatus according to claim 1, wherein the controller controls the transfer pressure applicator to adjust the secondary transfer pressure in accordance with at least one of a type and a smoothness of the recording medium.

3. The image forming apparatus according to claim 2, further comprising a detector to detect at least one of the type and the smoothness of the recording medium.

4. The image forming apparatus according to claim 2, further comprising a selector to select at least one of the type and the smoothness of the recording medium.

5. The image forming apparatus according to claim 1, wherein the special color toner is one of a white toner and a transparent toner.

6. The image forming apparatus according to claim 1, wherein the controller controls the transfer pressure applicator to adjust the secondary transfer pressure in accordance with an operating environment.

7. The image forming apparatus according to claim 1, further comprising a toner adhesion calculator to obtain a toner adhesion amount of the special color toner.

8. The image forming apparatus according to claim 7, wherein with an increase in the toner adhesion amount of the special color toner obtained by the toner adhesion calculator, the controller controls the transfer pressure applicator to reduce the secondary transfer pressure.

9. The image forming apparatus according to claim 1, further comprising a toner adhesion amount selector to select a toner adhesion amount of the special color toner.

10. The image forming apparatus according to claim 9, wherein with an increase in the toner adhesion amount of the special color toner selected by the toner adhesion selector, the controller controls the transfer pressure applicator to reduce the secondary transfer pressure.

11. An image forming apparatus, comprising:

an image forming station to form a toner image;

an intermediate transfer body onto which the toner image formed by the image forming station is transferred;

a transfer device to transfer the toner image from the intermediate transfer body onto a recording medium in a transfer nip;

a transfer pressure applicator to apply a secondary transfer pressure to the transfer nip upon transfer of the toner image to the recording medium; and a controller, operatively connected to the transfer pressure applicator, to determine whether the toner image is a first image including a special color toner or a second image consisting of a toner other than the special color toner, and to control the transfer pressure applicator to apply a first pressure upon transfer of the first image and apply a second pressure upon transfer of the second image, the first pressure being lower than the second pressure, wherein the special color toner has a first particle diameter, the toner other than the special color toner has a second particle diameter, and the first particle diameter is greater than the second particle diameter.

12. The image forming apparatus according to claim 11, further comprising a toner adhesion calculator to obtain a toner adhesion amount of the special color toner.

13. The image forming apparatus according to claim 12, wherein with an increase in the toner adhesion amount of the special color toner obtained by the toner adhesion calculator, the controller controls the transfer pressure applicator to reduce the secondary transfer pressure.

14. The image forming apparatus according to claim 11, further comprising a toner adhesion amount selector to select a toner adhesion amount of the special color toner.

15. The image forming apparatus according to claim 14, wherein with an increase in the toner adhesion amount of the special color toner selected by the toner adhesion selector, the controller controls the transfer pressure applicator to reduce the secondary transfer pressure.

16. An image forming apparatus, comprising:

an image forming station to form a toner image;

an intermediate transfer body onto which the toner image formed by the image forming station is transferred;

a transfer device to transfer the toner image from the intermediate transfer body onto a recording medium in a transfer nip;

a transfer pressure applicator to apply a secondary transfer pressure to the transfer nip upon transfer of the toner image to the recording medium; and a controller, operatively connected to the transfer pressure applicator to control the transfer pressure applicator, to determine whether the toner image is a first image including a special color toner or a second image consisting of a toner other than the special color toner, and to control the transfer pressure applicator to apply a first pressure upon transfer of the first image and apply a second pressure upon transfer of the second image, the first pressure being lower than the second pressure, wherein a maximum toner adhesion amount of the special color toner is a first amount, the maximum toner adhesion amount of the toner other than the special color toner is a second amount, and the first amount is greater than the second amount.

17. The image forming apparatus according to claim 16, further comprising a toner adhesion calculator to obtain a toner adhesion amount of the special color toner.

18. The image forming apparatus according to claim 17, wherein with an increase in the toner adhesion amount of the special color toner obtained by the toner adhesion calculator, the controller controls the transfer pressure applicator to reduce the secondary transfer pressure.

19. The image forming apparatus according to claim 16, further comprising a toner adhesion amount selector to select a toner adhesion amount of the special color toner.

20. The image forming apparatus according to claim 19, wherein with an increase in the toner adhesion amount of the special color toner selected by the toner adhesion selector, the controller controls the transfer pressure applicator to reduce the secondary transfer pressure.

* * * * *